US010555391B2

(12) United States Patent
Nietfeld

(10) Patent No.: US 10,555,391 B2
(45) Date of Patent: Feb. 4, 2020

(54) LIGHT-EMITTING DIODE ASSEMBLY, AND METHOD FOR DIMMING A LIGHT-EMITTING DIODE OF A LIGHT-EMITTING DIODE ASSEMBLY

(71) Applicant: HELLA GmbH & Co. KGaA, Lippstadt (DE)

(72) Inventor: Dieter Nietfeld, Paderborn (DE)

(73) Assignee: Hella GmbH & Co. KGAA, Lippstadt (DE)

( * ) Notice: Subject to any disclaimer, the term of this patent is extended or adjusted under 35 U.S.C. 154(b) by 0 days.

(21) Appl. No.: 16/016,944

(22) Filed: Jun. 25, 2018

(65) Prior Publication Data

US 2018/0310377 A1 Oct. 25, 2018

Related U.S. Application Data

(63) Continuation of application No. PCT/EP2016/079926, filed on Dec. 6, 2016.

(30) Foreign Application Priority Data

Dec. 23, 2015 (DE) ..... 10 2015 122 665

(51) Int. Cl.
*H05B 37/02* (2006.01)
*H05B 33/08* (2006.01)

(52) U.S. Cl.
CPC ..... *H05B 33/0845* (2013.01); *H05B 33/0818* (2013.01); *H05B 37/02* (2013.01)

(58) Field of Classification Search
CPC . H05B 33/0845; H05B 33/0818; H05B 37/02
(Continued)

(56) References Cited

U.S. PATENT DOCUMENTS

2001/0028227 A1* 10/2001 Lys ..... A61N 5/0616 315/317
2009/0303161 A1* 12/2009 Messmer ..... G09G 3/14 345/55

(Continued)

FOREIGN PATENT DOCUMENTS

CN 201363654 Y 12/2009
DE 102009041943 A1 3/2011

(Continued)

OTHER PUBLICATIONS

International Search Report dated Jan. 31, 2017 in corresponding application PCT/EP2016/079926.

*Primary Examiner* — Daniel D Chang
(74) *Attorney, Agent, or Firm* — Muncy, Geissler, Olds & Lowe, P.C.

(57) ABSTRACT

A light-emitting diode assembly having at least one light-emitting diode, a controller which is designed to dim the at least one light-emitting diode by means of pulse width modulation, wherein the pulse width modulation is characterized by a clock pulse and a pulse duration during a clock pulse. The controller is designed to actuate the at least one light-emitting diode with packets of at least two clock pulses. The controller being optionally designed to actuate the at least one light-emitting diode in a first operating mode and at least one second operating mode, wherein the at least one light-emitting diode is actuated in the first operating mode with the same pulse durations within the packet and is actuated in the second operating mode with at least one different pulse duration within the packet.

13 Claims, 3 Drawing Sheets

(58) Field of Classification Search
USPC ..... 315/291
See application file for complete search history.

(56) References Cited

U.S. PATENT DOCUMENTS

| | | | | |
|---|---|---|---|---|
| 2010/0164922 | A1 | 7/2010 | Nose et al. | |
| 2012/0044350 | A1* | 2/2012 | Verfuerth ..... | H05B 37/0272 348/143 |
| 2012/0207205 | A1 | 8/2012 | Zhao et al. | |
| 2015/0201478 | A1 | 7/2015 | Wittorf | |

FOREIGN PATENT DOCUMENTS

| | | | |
|---|---|---|---|
| DE | 102011004452 | A1 | 8/2011 |
| DE | 102012023786 | A1 | 6/2014 |

* cited by examiner

LIGHT-EMITTING DIODE ASSEMBLY, AND METHOD FOR DIMMING A LIGHT-EMITTING DIODE OF A LIGHT-EMITTING DIODE ASSEMBLY

This nonprovisional application is a continuation of International Application No. PCT/EP2016/079926, which was filed on Dec. 6, 2016, and which claims priority to German Patent Application No. 10 2015 122 665.0, which was filed in Germany on Dec. 23, 2015, and which are both herein incorporated by reference.

BACKGROUND OF THE INVENTION

Field of the Invention

The present invention relates to a light-emitting diode assembly and to a method for dimming a light-emitting diode of a light-emitting diode assembly.

Description of the Background Art

The brightness of light-emitting diodes (LEDs) can be adjusted by means of pulse width modulation (PWM). Essentially, the current of the light-emitting diode is periodically turned on and off by means of pulse width modulation (PWM). Here, the duty cycle (ratio of on to off time) is changed, whereas the current and pulse frequency are constant.

Such dimmable light-emitting diodes are used in many fields today for lighting purposes, for example, in PWM-dimmed LED traffic signs, LED car taillights, LED daytime running lights, but also in so-called matrix systems, which are used as headlights in motor vehicles and has, for example, of 100×100 LEDs or even 1000×1000 LEDs. In the last-mentioned matrix systems, for example, some LEDs are dimmed because otherwise glare effects can result. Thus, for example, those LEDs can be dimmed whose light is directed to highly reflective road signs. Finally, the light emitted by a matrix system can be dynamically adapted to the area to be illuminated.

If the PWM method is used for dimming particular light-emitting diodes, the so-called string of pearls effect can occur.

"The string of pearls effect is an optical illusion caused by rapid movements of the eyes towards or away from a pulsed light source. Due to the inertia of eye receptors, it leads to the multiple appearance of the light source, for example, PWM-dimmed light-emitting diode traffic signs or light-emitting diode car taillights. Depending on the pulse rate, this effect can occur even if in the case of direct viewing no flickering is noticeable, which can lead to irritation." (Source: www.emk.tu-darmstadt.de).

This is one of the reasons why the LEDs are switched at such a high frequency (PWM frequency) that the human eye does not perceive any flickering. As a rule, 250 Hz or more is an acceptable value.

The matrix systems mentioned above are frequently actuated by means of video interfaces. A standard is, for example, the RGB interface. Starting from, for example, RGB666 and the dimming information per LED of 6 bits, 64 dimming levels result ($2^6$). At a 250 Hz PWM frequency, the resulting clock pulse would be 4 ms. At 64 dimming levels, the resolution is 4 ms/64=62.5 μs. If, for example, a dimming of 50% is to be applied, the result is a turn-on time for a light-emitting diode of 2 ms and a turn-off time of 2 ms. At a resolution of 64 levels, the next higher possible dimming would be 2.0625 ms/4 ms=51.5%. This corresponds to an increment of 1.5%, which is too high for many applications. For example, clearly visible gratings result with a plurality of differently bright LEDs. Many OEMs demand resolutions of <1%.

SUMMARY OF THE INVENTION

It is therefore an object of the present invention to provide an improved light-emitting diode assembly, in particular proposing a light-emitting diode assembly which, on the one hand, prevents the string of pearls effect or has only a minimal string of pearls effect and, on the other hand, enables a finer dimming, in particular <1% steps.

In an exemplary embodiment, a finer dimming can occur and/or the string of pearls effect be prevented because the controller is designed to actuate the at least one light-emitting diode with packets of at least two clock pulses, wherein the controller is optionally designed to actuate the at least one light-emitting diode in a first operating mode and at least one second operating mode, wherein the at least one light-emitting diode is actuated in the first operating mode with the same pulse durations within the packet and is actuated in the second operating mode with at least one different pulse duration within the packet. One possible procedure is designed as follows.

Starting from the otherwise constant PWM frequency of 250 Hz and the resulting clock pulse T of 4 ms, a 51.5% brightness could be applied in the first clock pulse $T_1$ of 4 ms. At a resolution of 64 dimming levels ($2^6$), this corresponds to a pulse duration or a turn-on time of (33/64)*4 ms=2.0625 ms and a corresponding turn-off time of (31/64)*4 ms=1.9375 ms. In the next three clock pulses $T_2$ to $T_4$, for example, a 50% brightness can be applied, in other words, a 2 ms turn-on time and 2 ms turn-off time. In the four 4 ms clock pulses, which are combined into a packet P, the average value for the eye is (51.5%+3*50%)/4=50.375%. Accordingly, an increment of 0.375% can be achieved in this second operating mode with packets with different pulse durations, and therefore the resolution can be increased.

On the other hand, in the first operating mode, in which different pulse durations are not provided within the packet, the string of pearls effect can be advantageously counteracted when a correspondingly high PWM frequency is selected.

The light-emitting diode assembly can comprise a plurality of light-emitting diodes, in particular 100×100 or 1000×1000 light-emitting diodes, which are combined as a matrix system. A light-emitting diode assembly with this type of configuration can be used advantageously, for example, as the headlight of a vehicle.

The light-emitting diode assembly can be designed to illuminate at least one point, wherein the light-emitting diode assembly is equipped with a detection device which is designed to detect the relative moving speed, in particular angular speed, of the at least one point with respect to the detection device. An individual adaptation to lighting situations can be made by means of this measure, wherein the control unit accordingly carries out the actuation that is predetermined as optimal for the detected moving speed, in particular angular speed, of the illuminated point.

The controller can be designed to actuate the at least one light-emitting diode according to the first operating mode or the second operating mode as a function of the moving speed, in particular angular speed. Here, the control unit, for example, performs an actuation of the at least one light-emitting diode or groups of light-emitting diodes according to the first operating mode when the illuminated point performs a very rapid movement relative to the detection device. In contrast, a stationary point would experience, for example, an actuation in the second operating mode.

The controller can be designed to control the number of clock pulses combined into a packet, in particular as a function of the moving speed, in particular the angular speed. A further possibility of intervention by the controller with regard to the actuation of the at least one light-emitting diode is made possible by means of this technical feature. In this way, the resulting brightness modulation can be set via the number of clock pulses combined into a packet, wherein in the case of packets formed of fewer clock pulses, there tends to be the greater probability that the resulting brightness modulation is so high-frequency that it is not perceived by the human eye.

The detection device can be a camera, a radar system, or a laser system. Systems of this kind offer numerous possibilities for detecting the movement of the point or points and for preparing it accordingly for the controller.

A further object of the present invention is to propose an improved method for dimming a light-emitting diode of a light-emitting diode assembly, in particular to propose a method which counteracts a string of pearls effect and enables a finer dimming of the at least one light-emitting diode.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

A light-emitting diode assembly of the invention substantially comprises at least one light-emitting diode 1 and a controller 4, which is designed for dimming the at least one light-emitting diode by means of pulse width modulation, wherein the pulse width modulation is substantially determined by a clock pulse T and a pulse duration T within the clock pulse T.

A light-emitting diode assembly of the invention is characterized in that controller 4 is designed to actuate the at least one light-emitting diode 1 with packets P of at least two clock pulses T, wherein the pulse durations T within the clock pulses T of a packet P are the same (first operating mode) or at least one different pulse duration T is provided within a packet P (second operating mode).

As already indicated, this results in substantially two operating modes for actuating the light-emitting diode. For the sake of simplicity, in the following explanation, a first operating mode will be discussed when the pulse durations T within the clock pulses T of a packet P are the same, and a second operating mode when at least one different pulse duration T is provided within a packet P.

Figure 1:
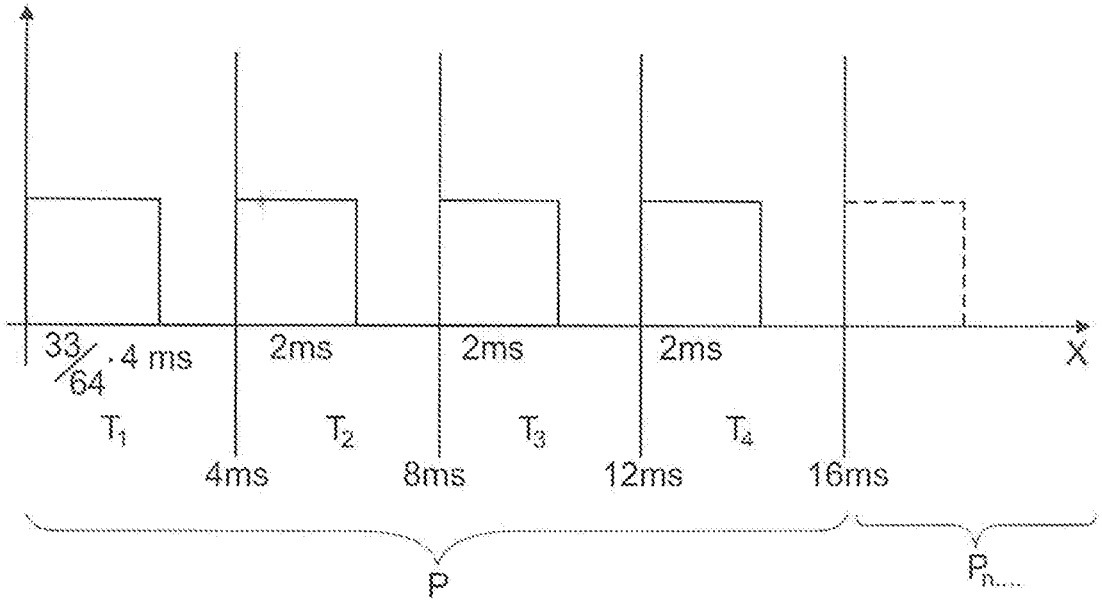
FIG. 1 shows an overview of the period durations with at least one different pulse duration in packets (second operating mode)
Figure 2:
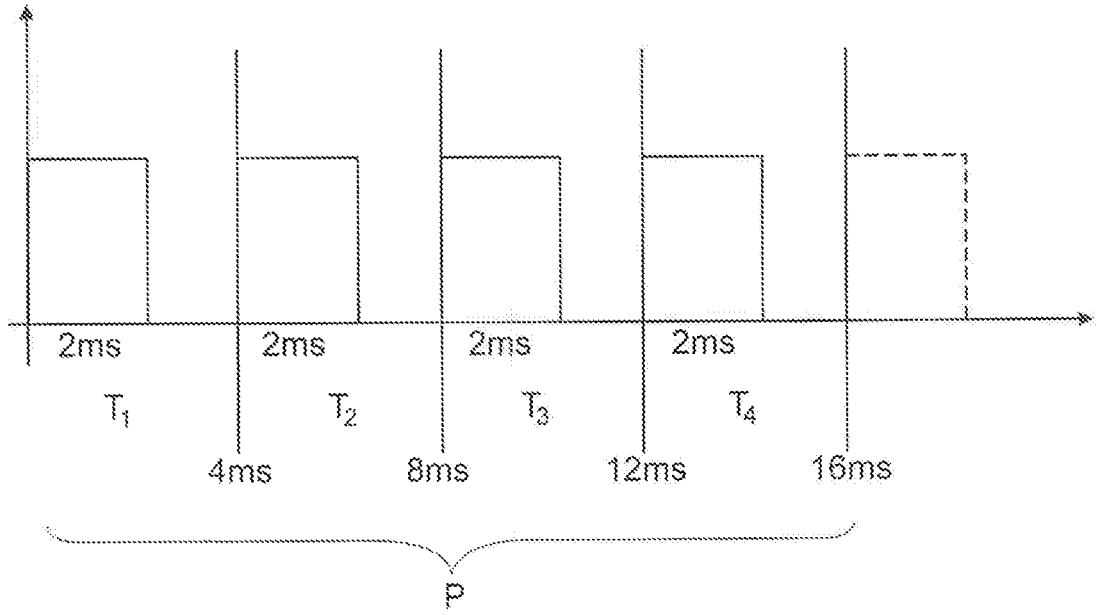
FIG. 2 shows an overview of the period durations with the same pulse durations in packets (first operating mode)

The two operating modes are shown in FIGS. 1 and 2 using the example of four clock pulses.

The light-emitting diode assembly can comprise more than one light-emitting diode, for example, a plurality of light-emitting diodes which are combined in a so-called matrix system into 100×100 or 1000×1000 LEDs.

The controller can be designed further to control the number of clock pulses combined into a packet. The packet can in principle comprise an integer multiple of the clock pulse, for example, two or four clock pulses.

The light-emitting diode assembly further can be designed to illuminate at least one point 6, wherein the light-emitting diode assembly is equipped with a detection device 5 which is designed to detect the relative moving speed of the at least one point 6 with respect to detection device 5.

In principle, any reflecting object that reflects the light emitted by the at least one light-emitting diode can be regarded as a point.

In this context, controller 4 can be designed to evaluate this movement information in order to actuate therefrom the at least one light-emitting diode 1 according to the first operating mode or the second operating mode and/or to control the number of clock pulses T combined into a packet P as a function of the moving speed of the at least one point 6.

Numerous possibilities, not exhaustively enumerated here, for the design of the light-emitting diode assembly of the invention or the method proposed according to the invention emerge from these control possibilities.

Basically, the pulse width modulation can be described based on its pulse duration T and the clock pulse T. The clock pulse, also called period duration, finally results from the PWM frequency as T=1/f.

To dim a light-emitting diode, the pulse duration T, also referred to as the turn-on time, is changed. Simply stated, the longer the pulse duration T within one clock pulse, the brighter the light-emitting diode, or the shorter the pulse duration T, the darker the light-emitting diode.

The light-emitting diode assembly, in particular controller 4, often receives its dimming information from a video interface, for example, in the RGB666 format, so that the dimming information is present at a resolution of 6 bits and 64 dimming stages ($2^6$) result.

A resolution of 4 ms/64=62.5 μs results at 64 dimming levels for light-emitting diode 1 and a PWM frequency of 250 Hz for the pulse width modulation. If, for example, a dimming of 50% is to be applied, the result is a turn-on time for a light-emitting diode 1 of 2 ms and a turn-off time of 2 ms. At a resolution of 64 levels, the next higher possible dimming would be 2.0625 ms/4 ms=51.5%. This corresponds to an increment of 1.5%.

Now smaller dimming steps can be achieved via the actuation of the at least one light-emitting diode 1 in the second operating mode.

Starting from the otherwise constant PWM frequency of 250 Hz and the resulting clock pulse T of 4 ms, a 51.5% brightness could be applied in the first clock pulse $T_1$ of 4 ms. At a resolution of 64 dimming levels ($2^6$), this corresponds to a pulse duration or a turn-on time of (33/64)*4 ms=2.0625 ms and a corresponding turn-off time of (31/64)*4 ms=1.9375 ms. In the next three clock pulses $T_2$ to $T_4$, for example, a 50% brightness can be applied, in other words, a 2 ms turn-on time and 2 ms turn-off time. In the four 4 ms clock pulses, which are combined into a packet P, the average value for the eye is (51.5%+3*50%)/4=50.375%. Accordingly, in this second operating mode with packets with different pulse durations, an increment of 0.375% can be achieved, and therefore the resolution can be increased. This approach could also be referred to as dithering. A disadvantage of this operating mode could be that a modulation of the brightness of 62.5 Hz in this example results because the length of a packet P is 16 ms and this packet P repeats accordingly every 16 ms.

In conjunction with the example mentioned above, packets P with the same pulse durations T in the clock pulses can be produced. This is schematically indicated in FIG. 2 by four clock pulses $T_1$ to $T_4$, which are combined into a packet P and all contain the same pulse durations. Finally, this corresponds to the first operating mode.

This results in advantageous properties of the light-emitting diode assembly for the two operating modes. In the first operating mode, a not so fine gradation of dimming is possible, but there is no modulation in the cycle of the packets and the string of pearls effect is reduced or not perceptible according to the selected clock frequency.

In contrast, the second operating mode opens the possibility for a finer gradation of dimming. However, it is not excluded that a brightness modulation perceptible to the human eye results. Furthermore, it is perhaps not precluded that this results in an albeit weak string of pearls effect.

In the case of packets formed of fewer clock pulses, the probability tends to be greater that the resulting brightness modulation is so high-frequency that it is not perceived by the human eye. For example, if a PWM frequency of 250 Hz is used, then the repetition rate of the packets of two clock pulses will be 125 Hz, whereas the repetition rate of packets of four clock pulses will be 62.5 Hz. The latter may perhaps be perceived by the human eye, whereas a modulation of 125 Hz may not be perceived.

Figure 3:
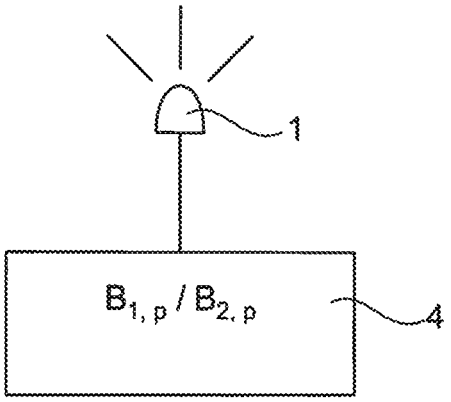
FIG. 3 shows a light-emitting diode assembly of the invention with a light-emitting diode in a schematic diagram.

A light-emitting diode assembly in a simple embodiment with a light-emitting diode and a controller is shown in FIG. 3. The reference characters $B_{tp}$ and $B_{2,p}$ are used to indicate that the light-emitting diode can be actuated in the first operating mode and in the second operating mode, with, for example, p=2 or 4 clock pulses per packet in each case.

Figure 4:
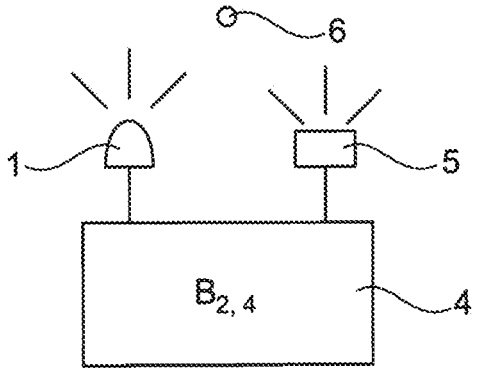
FIG. 4 shows a light-emitting diode assembly of the invention with a light-emitting diode and a detection device in a schematic diagram (stationary point)
Figure 4A:
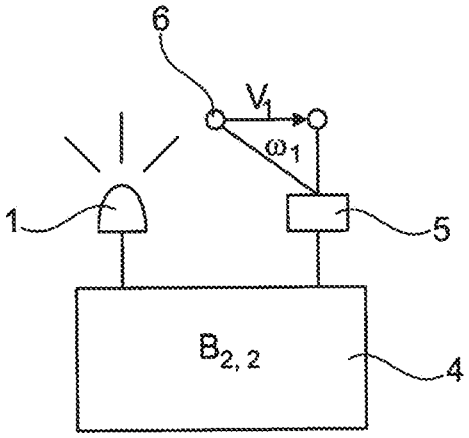
FIG. 4*a* shows a light-emitting diode assembly of the invention with a light-emitting diode and a detection device in a schematic diagram (moderate movement of the point)
Figure 4B:
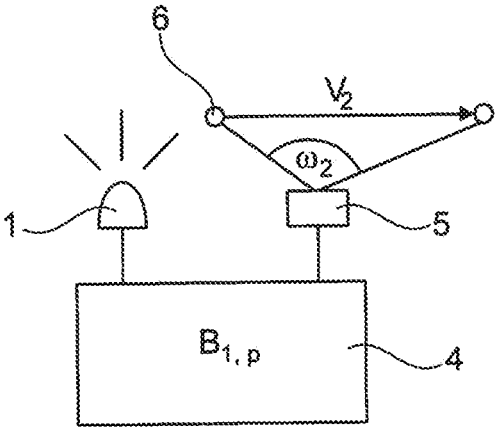
FIG. 4*b* shows light-emitting diode assembly of the invention with a light-emitting diode and a detection device in a schematic diagram (rapid movement of the point)

As already indicated above, the light-emitting diode assembly can comprise a detection device 5 in addition to light-emitting diode 1 and controller 4. FIGS. 4, 4*a*, and 4*b* show a schematic diagram of such a light-emitting diode assembly.

In principle, the at least one light-emitting diode 1 should be actuated in the second operating mode (dithering) if the point does not move (FIG. 4) or only moves moderately (FIG. 4*a*, $v_1$) and in the first operating mode (FIG. 4*b*) if the point moves rapidly ($v_2$), wherein in particular the angular velocity $\omega_1$ or $\omega_2$ of the point with respect to the detection device should be considered. Furthermore, a corresponding actuation can be made with regard to the clock pulses combined into a packet, for example, four clock pulses if the point does not move and two clock pulses if the point moves moderately fast. The advantages already described above with respect to resolution, string of pearls effect, and brightness modulation arise as a result.

The principles outlined above can also be applied to more than one light-emitting diode, in particular matrix systems comprising, for example, 100×100 or 1000×1000 light-emitting diodes. The controller in this case controls not only a light-emitting diode but each light-emitting diode of the matrix system.

Figure 5:
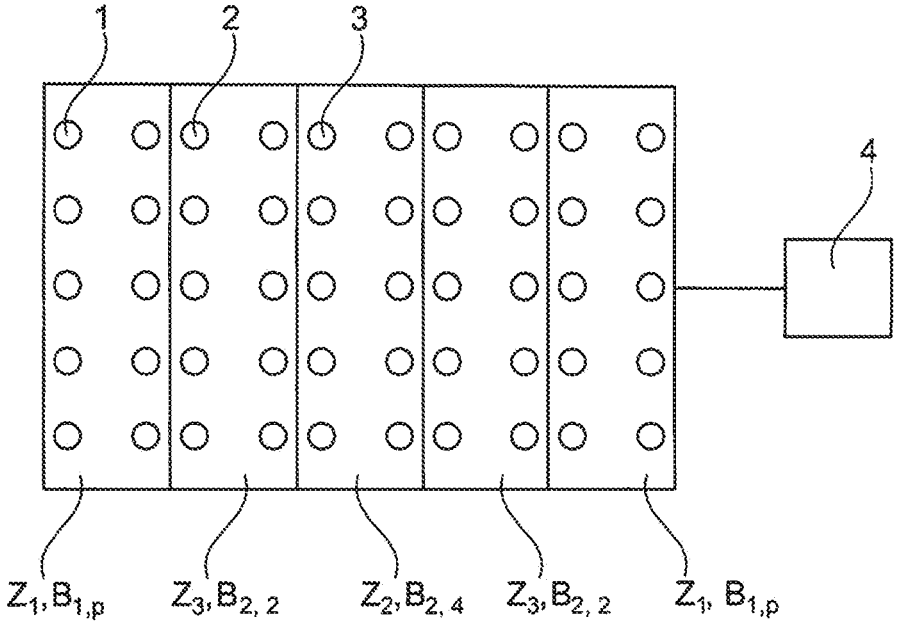
FIG. 5 shows a light-emitting diode assembly of the invention in the form of a matrix system without a detection device.
Figure 6:
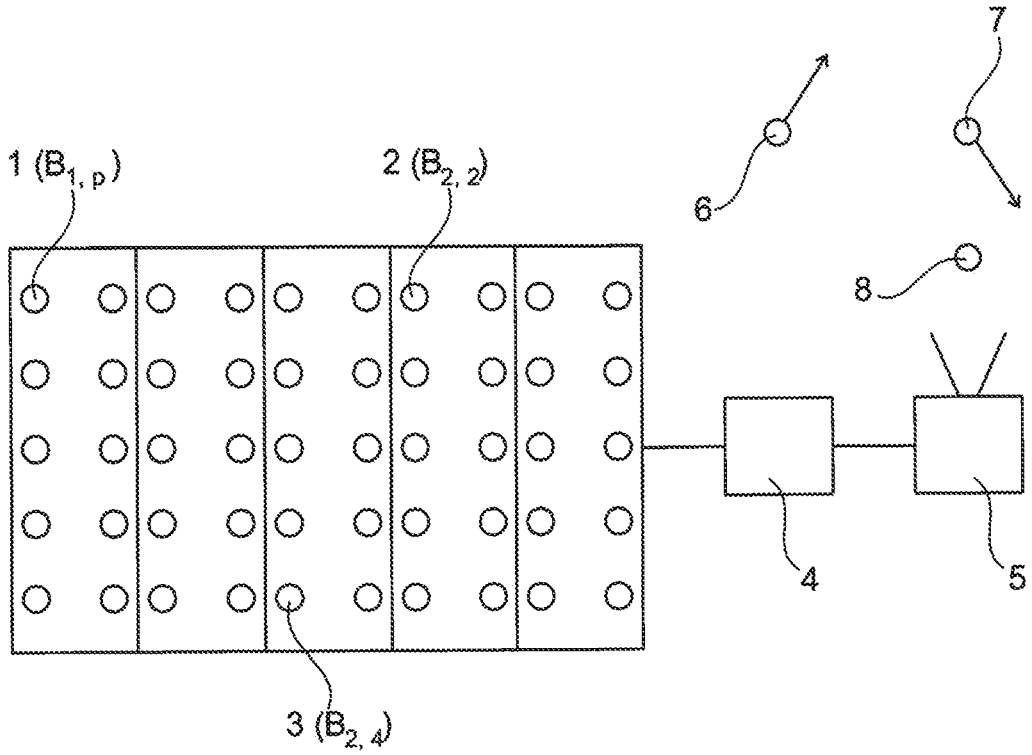
FIG. 6 shows a light-emitting diode assembly of the invention with a plurality of light-emitting diodes and a detection device in a schematic diagram (points in a first movement pattern).

In an embodiment of the light-emitting diode array as a matrix system, but without a detection device, frequently occurring lighting situations can be taken into account in order to use the above-described operating modes in a selective and advantageous manner. In this case, certain zones of light-emitting diodes of the matrix system can be combined, for example, a zone in which the light-emitting diodes in the first operating mode $B_1$ are actuated, a second zone in which the light-emitting diodes in the second operating mode with two cycles per packet $B_{2,2}$ are actuated, and a third zone in which the light-emitting diodes in the second operating mode with four clock pulses per packet $B_{2,4}$ are actuated. Of course, the number of clock pulses per packet refers only to exemplary values. The controller can be set up individually here and can define, for example, a maximum number of clock pulses that can be combined into packets. Such a lamp assembly is shown schematically in FIG. 5.

The light-emitting diode device described above can be advantageously explained by a practical example.

Starting from a matrix system such as, for example, the headlight of a motorcycle, the edges of the matrix system can be equipped, for example, with LEDs, which are actuated in the first operating mode, in other words, form the first zone $Z_1$. These outer zones $Z_1$ usually light up the roadside, which moves very quickly past the matrix system when the motorcycle is moving. Here, the expected modulation effect and a string of pearls effect are extremely undesirable; on the other hand, a fine gradation of dimming is not necessary, so that these LEDs can be actuated in the first operating mode.

In contrast, the central area of the matrix system illuminates more distant objects, which move relatively to a lesser extent or not at all, such as, for example, the middle of the road, etc. In this respect, for example, the central area of the matrix system can be actuated in the second operating mode $B_{2,4}$ with the maximum number of clock pulses per packet, so that a finer brightness gradation can be achieved. The second zone is correspondingly formed by the middle region.

Light-emitting diodes of the third zone can be arranged between the edges and the middle region, for example, because generally moderately moving points are illuminated by these light-emitting diodes. It is advantageous in this regard to actuate these light-emitting diodes in the second operating mode $B_{2,2}$ with, for example, two clock pulses per packet.

The above-described light-emitting diode assembly in the form of a matrix system can likewise be equipped with a detection device. The light-emitting diode assembly accordingly illuminates a plurality of points. The detection device can be designed accordingly to detect the movement of each point illuminated by the matrix system. This can be refined to the extent that the point that is illuminated can be detected for each light-emitting diode, whereupon based on the movement of the point, the controller is designed to actuate the corresponding light-emitting diode with the appropriate operating mode and/or to make the appropriate settings with respect to the number of clock pulses combined into a packet.

To demonstrate this with a concrete example, the example of the main headlight of a motorcycle can be repeated. The motorcycle rides along a country road; the first light-emitting diode illuminates a point of the roadside, such as, for example, an edge marker post. The second light-emitting diode illuminates a vehicle approaching in cross traffic and the third light-emitting diode zone illuminates a bridge at some distance. The detection device detects this scenario and actuates the zones or light-emitting diodes in the corresponding operating mode and with the appropriate number of clock pulses within the packets.

If the scenario changes, for example, the first light-emitting diode illuminates a point stationary relative to the detection device, the controller actuates the first light-emitting diode in the second operating mode (dithering), etc.

The example described above assumes a very ideal type of assignment of light-emitting diodes and points illuminated by them. This level of detail can basically be reached. In practice, however, light-emitting diodes of the matrix system can also be combined into zones that are correspondingly actuated in accordance with the movement of the illuminated points by the controller.

The angular velocity should be taken as a basis in a first approximation with regard to the relative movement between the detection device and the point. A point that moves directly toward the detection device or the light-emitting diode assembly in fact has a relative movement with respect to the detection device, but it is negligible in terms of the string of pearls effect because there is no transverse movement.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A light-emitting diode assembly comprising:

at least one light-emitting diode; and a controller configured to dim the at least one light-emitting diode via pulse width modulation, the pulse width modulation having a clock pulse and a pulse duration during the clock pulse, wherein the controller actuates the at least one light-emitting diode with packets of at least two clock pulses, wherein the controller actuates the at least one light-emitting diode in a first operating mode and at least one second operating mode, and wherein the at least one light-emitting diode is actuated in the first operating mode with all of the at least two clock pulses within the packet having a same pulse duration and the at least one light-emitting diode is actuated in the second operating mode with at least one of the at least two clock pulses having a different pulse duration than another one of the at least two clock pulses within the packet.

2. The light-emitting diode assembly according to claim 1, wherein the light-emitting diode assembly comprises a plurality of light-emitting diodes or comprises 100×100 or 1000×1000 light-emitting diodes, which are combined as a matrix system.

3. The light-emitting diode assembly according to claim 1, wherein the light-emitting diode assembly is designed to illuminate at least one point, wherein the light-emitting diode assembly has a detection device that detects a relative moving speed or an angular speed of the at least one point with respect to the detection device.

4. The light-emitting diode assembly according to claim 3, wherein the controller actuates the at least one light-emitting diode in the first operating mode or the second operating mode as a function of the moving speed or the angular speed.

5. The light-emitting diode assembly according to claim 3, wherein the controller is designed to control the number of clock pulses combined into a packet as a function of the moving speed or the angular speed.

6. The light-emitting diode assembly according to claim 3, wherein the detection device is a camera, a radar system, or a laser system.

7. The light-emitting diode assembly according to claim 3, wherein the number of clock pulses in the second operating mode are changed depending upon the moving speed or the angular speed.

8. A method for dimming a light-emitting diode of a light-emitting diode assembly, the method comprising:

providing at least one light-emitting diode with a controller that dims the at least one light-emitting diode via pulse width modulation, wherein the pulse width modulation has a clock pulse and a pulse duration during the clock pulse;

forming packets of at least two clock pulses; and actuating the at least one light-emitting diode in a first operating mode in that the at least one light-emitting diode is actuated with all of the at least two clock pulses within the packet having a same pulse duration or in a second operating mode in that the at least one light-emitting diode is actuated with at least one of the at least two clock pulses having a different pulse duration than another one of the at least two clock pulses within the packet.

9. The method according to claim 8, wherein a number of clock pulses combined into a packet is controlled by the controller.

10. The method according to claim 8, wherein the light-emitting diode assembly comprises a plurality of light-emitting diodes or 100×100 or 1000×1000 light-emitting diodes that are combined as a matrix system, wherein each light-emitting diode or groups of light-emitting diodes are actuated individually by the controller with regard to the first operating mode or the second operating mode and is controlled with regard to the number of clock pulses combined into a packet.

11. The method according to claim 8, wherein the light-emitting diode assembly illuminates at least one point, wherein the light-emitting diode assembly is equipped with a detection device, and wherein the detection device detects a relative moving speed or angular speed of the at least one point with respect to the detection device.

12. The method according to claim 11, wherein the operating mode and/or the number of clock pulses combined into a packet is controlled as a function of the moving speed or angular speed detected by the detection device.

13. The method according to claim 11, wherein the number of clock pulses in the second operating mode are changed depending upon the moving speed or the angular speed.

* * * * *